US010455955B2

(12) United States Patent
Jacobson et al.

(10) Patent No.: US 10,455,955 B2
(45) Date of Patent: Oct. 29, 2019

(54) WALL MOUNTED STORAGE DEVICE WITH INTEGRATED HINGE

(71) Applicant: STEEL WAVE VENTURES, LLC, Alpharetta, GA (US)

(72) Inventors: Daniel Jacobson, Alpharetta, GA (US); David Vanarsdale, Atlanta, GA (US); Garrett Simmer, Atlanta, GA (US)

(73) Assignee: Steel Wave Ventures, LLC, Alpharetta, GA (US)

( * ) Notice: Subject to any disclaimer, the term of this patent is extended or adjusted under 35 U.S.C. 154(b) by 37 days.

(21) Appl. No.: 15/563,494

(22) PCT Filed: Mar. 30, 2016

(86) PCT No.: PCT/US2016/025020

§ 371 (c)(1),
(2) Date: Sep. 29, 2017

(87) PCT Pub. No.: WO2016/160998

PCT Pub. Date: Oct. 6, 2016

(65) Prior Publication Data

US 2018/0092471 A1 Apr. 5, 2018

Related U.S. Application Data

(60) Provisional application No. 62/140,313, filed on Mar. 30, 2015.

(51) Int. Cl.

| | |
|---|---|
| ***A47F 5/08*** | (2006.01) |
| ***A47B 23/04*** | (2006.01) |
| ***A47B 97/00*** | (2006.01) |

(52) U.S. Cl.

CPC ..... *A47F 5/0876* (2013.01); *A47B 23/04* (2013.01); *A47B 97/00* (2013.01); *A47B 2097/006* (2013.01); *A47F 5/0807* (2013.01)

(58) Field of Classification Search

USPC ..... 248/685, 686, 689, 447, 451, 452, 453, 248/316.3, 682, 690, 691; 40/658, 40/611.12; 211/89.01, 47, 48, 50, 51

See application file for complete search history.

(56) References Cited

U.S. PATENT DOCUMENTS

| | | | | |
|---|---|---|---|---|
| 307,142 | A * | 10/1884 | Rex | |
| 769,375 | A * | 9/1904 | Cain | 40/653 |
| 792,594 | A | 6/1905 | Hiss, Jr. | |
| 921,271 | A | 5/1909 | Munger | |
| 1,214,795 | A * | 2/1917 | Kinkelaar | A47G 25/10 211/32 |
| 1,311,089 | A * | 7/1919 | Parker | A47G 1/16 248/316.3 |

(Continued)

FOREIGN PATENT DOCUMENTS

| | | | | |
|---|---|---|---|---|
| DE | 839077 C | * | 5/1952 | A47G 1/21 |

*Primary Examiner* — Alfred J Wujciak
(74) *Attorney, Agent, or Firm* — Seed IP Law Group LLP

(57) ABSTRACT

A storage device coupleable to a structure includes a mounting plate and an external plate coupled to the mounting plate to define a receiving cavity. The storage device also includes a hinge plate received in the receiving cavity and coupled to the external plate, with the hinge plate pivotably moveable about a pivot axis between an open position and a closed position.

14 Claims, 4 Drawing Sheets

(56) References Cited

U.S. PATENT DOCUMENTS

| | | | | | |
|---|---|---|---|---|---|
| 1,509,303 | A | * | 9/1924 | Leyane et al. | A47F 7/163 211/45 |
| 1,605,581 | A | * | 11/1926 | Heath | C14B 1/26 211/45 |
| 1,703,952 | A | * | 3/1929 | Prince | A47G 1/21 211/13.1 |
| 1,727,200 | A | * | 9/1929 | Gillet | A47K 10/12 248/316.3 |
| 3,025,947 | A | | 3/1962 | Hammer | |
| 4,324,337 | A | * | 4/1982 | Hermalahti | A47G 25/0657 211/88.04 |
| 4,623,113 | A | * | 11/1986 | Studebaker | A47G 7/044 248/311.2 |
| D327,095 | S | | 6/1992 | Meyer | |
| D331,855 | S | | 12/1992 | Kaplan | |
| D747,119 | S | | 1/2016 | Jacobson et al. | |
| 2010/0276384 | A1 | | 11/2010 | Mak | |
| 2011/0215023 | A1 | | 9/2011 | Archie, Jr. et al. | |
| 2014/0014672 | A1 | * | 1/2014 | Hill | B65D 25/205 220/694 |
| 2014/0345227 | A1 | | 11/2014 | Thrush | |

* cited by examiner

WALL MOUNTED STORAGE DEVICE WITH INTEGRATED HINGE

CROSS-REFERENCE(S) TO RELATED APPLICATION(S)

This application claims the benefit of U.S. Provisional Patent Application No. 62/140,313 filed Mar. 30, 2015, which is hereby incorporated by reference in its entirety.

BACKGROUND

Technical Field

The present disclosure is related to storage devices and, more particularly, to a vertically mounted storage device with an integrated hinge.

Description of the Related Art

Use of hand-held computing devices, such as laptops and tablets, has become widespread. Users frequently encounter situations where such devices have to be temporarily stored. By way of example, users may need to store such devices when visiting restrooms in airports, coffee shops, fitness centers, etc. In such situations, users may be inconvenienced by having to search for a secure place to temporarily store such devices. Alternatively, users may be forced to precariously balance their device, un-sanitarily set down their device, or deal with their device in another undesirable way when they are otherwise occupied.

BRIEF SUMMARY

Users of portable devices, such as laptop computers, tablet computers, mobile phones, industrial controllers, and other computing and non-computing devices sometimes find themselves with a need to put down the portable device. One example of such need is when the user enters a restroom in a public place. Other such examples are when a user enters a cafeteria, a conference room, a classroom, an auditorium, a garage, a hospital room, a child-care facility, or some other locus where germs, air-borne matter, or other undesirable conditions are present. Since the area may be unsanitary or otherwise inhospitable to certain portable devices, putting the portable device down on a floor or counter is undesirable. The user will also find it undesirable to try to balance the portable device on their person when they are otherwise occupied.

To solve the problem of a lack of suitable storage in certain locations, embodiments of storage devices with an integrated hinge are described. The subject storage devices are vertically mounted, for example on a wall.

An embodiment includes a mounting plate, an external plate coupled to the mounting plate to define a receiving cavity, and a hinge plate received in the receiving cavity and coupled to the external plate. The hinge plate is pivotably moveable about a pivot axis between an open position and a closed position.

Optionally, some embodiments of storage devices with an integrated hinge include a hook member extending generally perpendicularly relative to the pivot axis. These embodiments may also include a mounting member coupled to the structure, the mounting member including a threaded member, the threaded member configured to couple the mounting member to the hook member. In some cases, the hook member includes an insert, the insert configured to coupleably receive the threaded member.

In still other optional embodiments, the storage device with the integrated hinge includes a receiving portion. The receiving portion has a contact surface to receive an object. The object contacting the contact surface is arranged to rotatably move the hinge plate from the open position to the closed position.

A storage device with an integrated hinge coupleable to a structure may be summarized as including: a mounting plate; an external plate coupled to the mounting plate to define a receiving cavity; and a hinge plate received in the receiving cavity and coupled to the external plate, the hinge plate pivotably moveable about a pivot axis between an open position and a closed position.

A storage device with an integrated hinge may further include: a hook member extending substantially perpendicular relative to the mounting plate. A storage device with an integrated hinge may further include: a mounting member coupleable to the structure, the mounting member including a threaded component, the threaded component configured to couple the mounting member to the hook member. The hook member may include an insert, the insert configured to coupleably receive the threaded component. The hinge plate may include a receiving portion, the receiving portion having a contact surface to receive an object, wherein the hinge plate may be arranged to rotatably move the hinge plate from the open position to the closed position when the object imposes on the contact surface. The integrated hinge may be arranged to translate an outward force imposed on the object into a perceptible upward force imposed on the object. A storage device with an integrated hinge may further include: a mounting member coupleable to the structure, wherein the mounting plate includes a cutout portion shaped to cooperate with a perimeter shape of the mounting member. At least one external surface of the storage device may be arranged with a commercial message or an instructive message. The external plate may further include: a pivot pin; and a support structure mechanism, wherein the support structure mechanism may be coupled to the hinge plate via the pivot pin. The support structure mechanism may be integrated with the external plate.

A storage device method may be summarized as including: longitudinally aligning a mounting member on a substantially vertical surface, the mounting member having at least one hook structure protruding substantially perpendicular to a planar surface of the mounting member; fastening the mounting member to the substantially vertical surface via at least one fastener; cooperatively arranging a mounting plate about the fastened mounting member; aligning one or more apertures in a hinge plate with one or more corresponding apertures in a support structure; introducing a pivot pin through the one or more apertures in the hinge plate with the one or more corresponding apertures in the support structure, the pivot pin arranged to render the hinge plate pivotably moveable between an open position and a closed position; and coupling an external plate to the mounting plate, the external plate having an upper portion, an intermediate portion, and a lower portion, the upper portion in part forming a cavity to receive the hinge plate, the intermediate portion in proximity to the support structure, and the lower portion contacting the mounting member.

The support structure may be integrated with the external plate. A storage device method may further include: introducing an object into a cavity between the mounting plate and the hinge plate; advancing the object downward within the cavity, the advancing causing the hinge plate to pivot toward the closed position. A storage device method may include: withdrawing the object upward and outward from the cavity between the mounting plate and the hinge plate, the outward withdrawing imposing a force on a first portion of the hinge plate, the force translated through the hinge plate into an upward force on the object. A storage device method may include: fastening the mounting plate to the substantially vertical surface.

A storage device may be summarized as including: a bracket means for securing the storage device to a substantially vertical surface; a mounting plate for forming a first part of a cavity to receive a first object; a cradle means for forming a second part of the cavity, the cradle means adapted to pivot about an axis from an open position when the cavity is empty toward a closed position when the first object is in the cavity; an exterior plate means for supporting the cradle means; and a hook means for suspending a second object.

A storage device may include: a bias means for biasing the cradle means into the open position when the cavity is empty. The cradle means may be shaped and pivotably mounted to impose an upward force on the first object when an outward force is imposed on the first object. A storage device may include: a hook mounting means integrated with the bracket means for coupling the hook means and the exterior plate means to the bracket means. The hook means may be arranged with at least one commercial message or at least one instructive message.

DETAILED DESCRIPTION

In the following description, certain specific details are set forth in order to provide a thorough understanding of various disclosed embodiments. One skilled in the relevant art will recognize that embodiments may be practiced without one or more of these specific details. In other instances, well-known structures and devices associated with storage devices may not be shown or described in detail to avoid unnecessarily obscuring descriptions of the embodiments.

Unless the context requires otherwise, throughout the specification and claims which follow, the word "comprise" and variations thereof, such as, "comprises" and "comprising," are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense including "and/or" unless the content clearly dictates otherwise.

Figure 1:
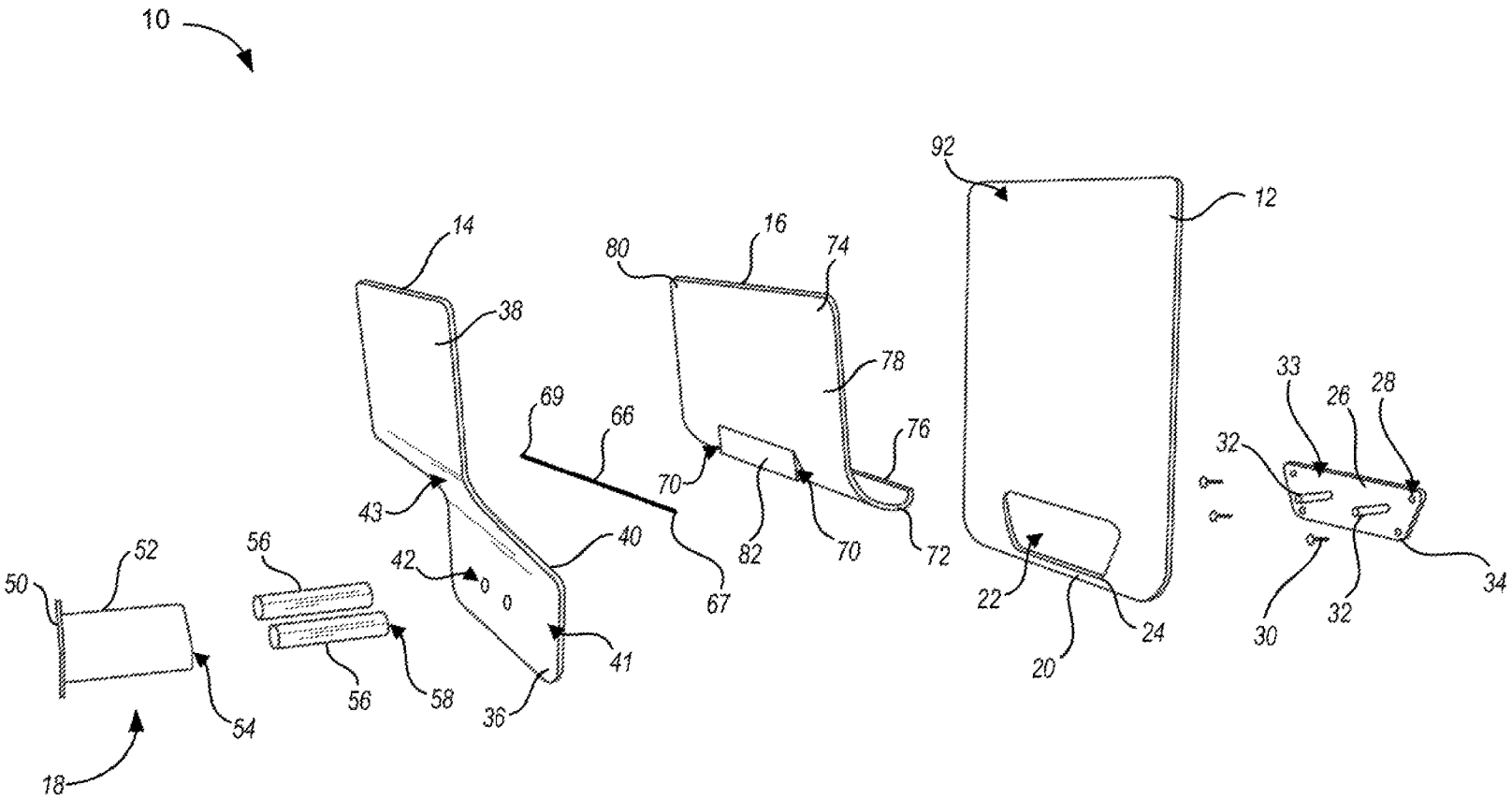
FIG. 1 is an exploded view of a wall mounted storage device with an integrated hinge, according to one embodiment.
Figure 2:
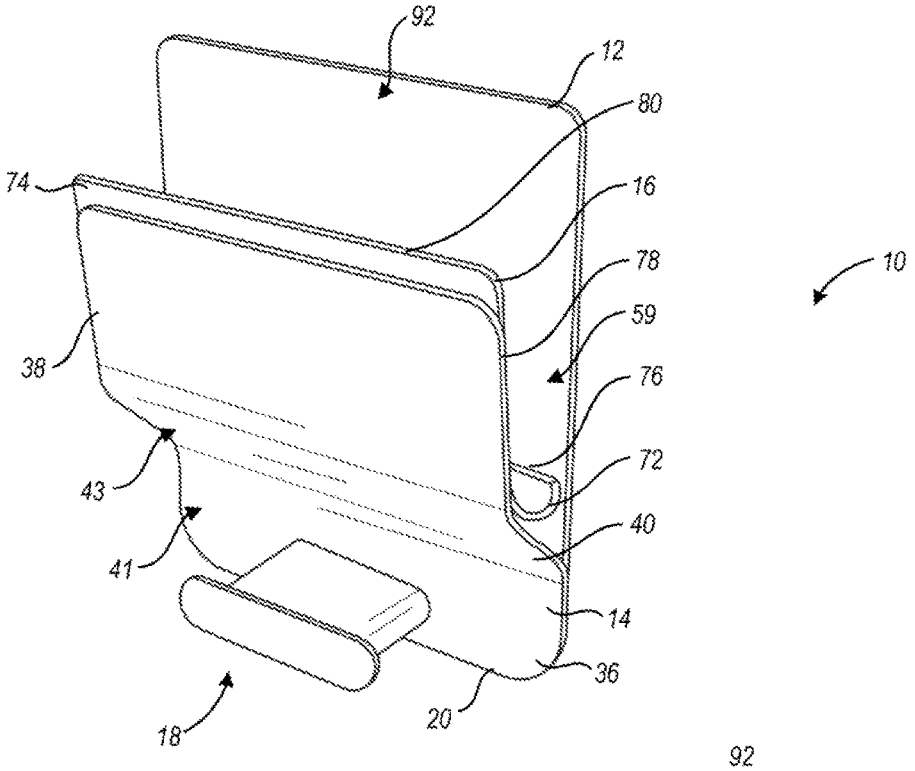
FIG. 2 is a perspective view of the wall mounted storage device with an integrated hinge of FIG. 1 in an open position.
Figure 3:
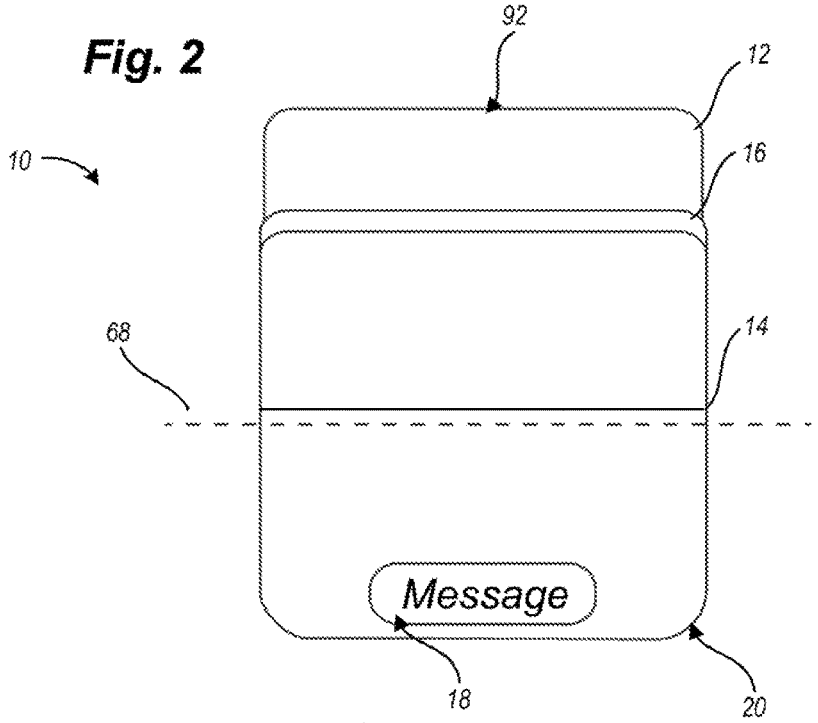
FIG. 3 is a front elevation view of the wall mounted storage device with an integrated hinge of FIG. 1.

FIGS. 1 through 3 illustrate a wall mounted storage device with an integrated hinge 10, according to one embodiment. The wall mounted storage device with an integrated hinge 10 generally may be mounted on building structures, such as walls, columns, ceilings, fixtures, or any other suitable structure. The wall mounted storage device with an integrated hinge 10 may also be mounted on common office and household furnishings, such as boards, tables, partitions, cubicle walls, or any other suitable furnishing. The wall mounted storage device with an integrated hinge 10 may in some cases be vertically mounted, attached, affixed, or otherwise integrated with any other type of structure including pillars, columns, poles, posts, stanchions, partitions, dividers, screens, abutments, and the like. The wall mounted storage device with an integrated hinge 10 includes a mounting plate 12, an exterior plate 14, a hinge plate 16, and a hook member 18.

Where in the present disclosure and any claims that follow the wall mounted storage device with an integrated hinge 10 is described as being "wall mounted," it is understood that "wall mounted" means that the device is arranged in a substantially vertical direction on a structure that may be a wall but is not necessarily a wall. The wall mounted storage device with an integrated hinge 10 may be mounted on any type of permanent, semi-permanent, transportable, or temporary structure. The structure may be indoors, outdoors, partially indoors and partially outdoors, under cover, protected from outside elements, or exposed to outside elements. In some cases, the wall mounted storage device with an integrated hinge 10 is integrated with or otherwise includes a separate and distinct structure, which may be a free-standing structure.

Where in the present disclosure and any appended claims the wall mounted storage device with an integrated hinge 10 is described as being "mounted" in a substantially vertical direction, the term "mount" in all of its grammatical forms means that the device is attached, affixed, integrated, fastened, joined, connected to, stuck, adhered, secured, tied, bound, pinned, nailed, welded, linked, coupled, added on, annexed, tacked, harnessed, or otherwise united. The mounting may be performed with screws or other like threaded instruments, nails, tacks, staples, adhesives, magnets, clips, buttons, catches, clasps, hinges, hook-and-eye materials, or other like devices.

Where in the present disclosure and any appended claims the wall mounted storage device with an integrated hinge 10 is described as being mounted in a substantially "vertical" direction, the term "vertical" is understood with reference to a Cartesian coordinate system wherein the device is mounted in the "Z" plane or parallel to the "Z" axis, which is normal to two perpendicular axes, "X" and "Y." In such a system, for example, the X and Y axes are understood to be at right angles to each other along the earth, and the Z axis is understood to be at a right angle to both the X and Y axes rising up from the earth.

Where the terms "substantial" or "about" in any grammatical form are used as modifiers in the present disclosure and any appended claims (e.g., to modify a structure, a dimension, a measurement, or some other characteristic), it is understood that the characteristic may vary by up to 30 percent. For example, a wall mounted storage device with an integrated hinge 10 may be described as being mounted "substantially vertical," In these cases, a device that is mounted exactly vertical is mounted along a "Z" axis that is normal (i.e., 90 degrees or at right angle) to a plane formed by an "X" axis and a "Y" axis. Different from the exact precision of the term, "vertical," the use of "substantially" to modify the characteristic permits a variance of the "vertical" characteristic by up to 30 percent. Accordingly, a wall mounted storage device with an integrated hinge 10 that is mounted "substantially vertical" includes devices mounted between 63 degrees and 117 degrees. A wall mounted storage device that is mounted at 45 degrees of an X-Y plane, however, is not mounted "substantially vertical." As another example, a wall mounted storage device with an integrated hinge 10 having a particular linear dimension of "between about 6 inches and 10 inches" includes such devices in which the linear dimension varies by up to 30 percent. Accordingly, the particular linear dimension of the wall mounted storage device with an integrated hinge 10 may be between 3 inches and 13 inches.

In some embodiments, the mounting plate 12 may have a generally rectangular shape with rounded corners. In other embodiments, the mounting plate 12 may have a trapezoidal shape, square shape, circular shape, or any other suitable shape. Proximal to a lower edge 20, the mounting plate 12 includes a shaped recess 22. While the shaped recess 22 shown in FIGS. 1 through 3 includes a generally trapezoidal shape, other suitable shapes are within the scope of the disclosed subject matter. For instance, in some embodiments, the shaped recess 22 may have a square, rectangular, circular, or other suitable shape. More particularly, the shaped recess 22 includes a peripheral boundary 24 (i.e., upper, lower, left, right sides, transitioning corners, etc.). The peripheral boundary 24 is sized and shaped to receive therein a mounting member 26.

The mounting member 26 includes a plurality of mounting apertures 28. The mounting apertures 28 extend through the mounting member 26 and are configured to receive fasteners 30 (e.g., screws, bolts, studs, etc.). The mounting member 26 further includes one or more hook support members 32, such as threaded rods, studs, or the like, extending outwardly from an external surface 33. The hook support members 32 may be integral with the mounting member 26, or may be coupled to the mounting member 26 by welds, fasteners, adhesives, or the like. While the embodiment of the mounting member 26 shown in FIGS. 1 through 3 includes a pair of hook support members 32, in other embodiments, the mounting member 26 may include any number of hook support members 32. The mounting member 26 is coupleable to building structures, office furnishings, home furnishings, or any other suitable structure (collectively referred to herein as "structure"). The mounting member 26 can be coupled to the structure via fasteners 30.

When the mounting member 26 is coupled to the structure, as discussed above, the mounting member 26 extends partially or completely through the shaped recess 22 of the mounting plate 12. In this manner, a peripheral boundary 34 of the mounting member 26 is to a large extent surrounded or abutted by the peripheral boundary 24 of the mounting plate 12. Thus, when the mounting plate 12 is coupled to the mounting member 26 or in proximity thereto, a rear face of the mounting plate 12 abuts or makes contact with the structure and the combination of the mounting plate 12 and the mounting member 26 provides an appearance of a unitary structure.

With continued reference to FIGS. 1 through 3, the exterior plate 14 includes a lower portion 36, an upper portion 38, and an intermediate portion 40. The intermediate portion 40 extends outwardly at a non-zero angle with respect to an outer surface 41 of the lower portion 36. The upper portion 38 extends outwardly at a non-zero angle with respect to an outer surface 43 of the intermediate portion 40.

The lower portion 36 of the exterior plate 14 includes apertures 42 which extend through the lower portion 36. The apertures 42 are configured to receive therethrough the hook support members 32 of the mounting member 26. More particularly, when the exterior plate 14 is coupled to the mounting member 26, an inner surface 45 (FIGS. 5A, 5B) of the lower portion 36 abuts or makes contact, at least in part, with the external surface 33 of the mounting member 26, such that the hook support members 32 extend through the apertures 42 of the exterior plate 14. The hook support members 32 are configured to be received by the hook member 18.

The hook member 18 includes a plate portion 50 and a stem portion 52. The stem portion 52 includes one or more insert cavities 54 extending at least partially through the stem portion 52. The insert cavities 54 are configured to coupleably receive therein one or more inserts 56, the number of inserts 56 corresponding to the number of hook support members. The inserts 56 may include hook support cavities 58, which may be, for example, threaded. The hook support cavities 58 are configured to coupleably receive therein the hook support members 32, such that the hook member 18 can secure the exterior plate 14 and the mounting plate 12 to the mounting member 26. In some embodiments, the hook support members 32 and hook support cavities 58 are joined in a threaded union. When the hook member 18 secures the exterior plate 14 and the mounting plate 12 to the mounting member 26, the hook member 18 extends generally perpendicular to the external surface 33 of the mounting member 26, and at least a portion of the stem portion 52 is exposed to an exterior. The exposed stem portion 52 therefore can receive any number of items to be hung thereon, such as bags, coats, hangars, etc., with the plate portion 50 providing a stop, which can prevent an item sliding off the hook member 18.

The upper, lower, and intermediate portions 36, 38, 40 of the exterior plate 14 define a generally z-shaped cross-section, such that when the exterior plate 14 is coupled to the mounting member 26, the exterior plate 14 defines a receiving cavity 59 (FIG. 2). The receiving cavity 59 is sized and shaped to receive therein hinge plate 16 and any object 11

(FIGS. 4 through 5) to be secured, such as a hand-held computing device (e.g., laptop, tablet, or the like), a book, a briefcase, a bag, a pad or stack of papers, one or more periodicals, or any other object suitably sized and shaped to enter the cavity formed between the mounting member 26 and the hinge plate 16. More particularly, the exterior plate 14 includes a hinge member 62 (FIGS. 5A and 5B) that protrudes outwardly from the lower portion 36. In some embodiments, the hinge member 62 may be integral with the exterior plate 14. In other embodiments, the hinge member 62 may be coupled to the exterior plate 14 through fasteners, welds, adhesives, etc. The hinge member 62 is configured to hingedly couple the exterior plate 14 to the hinge plate 16. The hinge member 62 includes a hinge aperture 64 (FIGS. 5A and 5B) extending therethrough. The hinge aperture 64 is configured to receive therethrough a pivot pin 66. The pivot pin 66 defines a pivot axis 68 (FIG. 3) and extends through the hinge aperture 64. The pivot pin 66 includes first and second ends 67, 69 which are received by respective receiving recesses 70 of the hinge plate 16, as discussed in more detail below.

In some embodiments, the wall mounted storage device with an integrated hinge 10 may include a pair of spaced-apart hinge members. The hinge members may be configured to have a lower portion coupleable to the exterior plate 14 and an upper portion coupleable to the hinge plate 16. The hinge members may further be configured to receive the pivot pin 66, such that the hinge plate 16 is hingedly coupled to the exterior plate 14. The wall mounted storage device with an integrated hinge 10 may also include a biasing mechanism, such as a spring, for example. The biasing mechanism may be coupled to the pivot pin 66, such that the hinge plate 16 may be biased in either an open or a closed position, as discussed in more detail below.

The hinge plate 16 includes a receiving portion 72 and a securing portion 74. The receiving portion 72 is generally C-shaped having a lip portion 76 at one end and extending into the securing portion 74 from the other end. The securing portion 74 has a flat portion 78 and an end lip portion 80. The receiving and securing portions 72, 74 may generally have an S-shaped cross-section; however, in other embodiments, the cross-sectional shape of the hinge plate 16 may include any number of shapes. As illustrated in FIG. 1, the hinge plate 16 includes a recessed portion 82 at a back side thereof. The recessed portion 82 is configured to receive therein the hinge member 62 when the hinge plate 16 is coupled to the exterior plate 14. The recessed portion 82 extends longitudinally, with opposing ends thereof extending into the receiving recesses 70. More particularly, the pivot pin 66 extends through the hinge aperture 64 and the first and second ends 67, 69 connect to the respective receiving recesses 70 to hingedly couple the hinge plate 16 to the exterior plate 14.

Figure 4A:
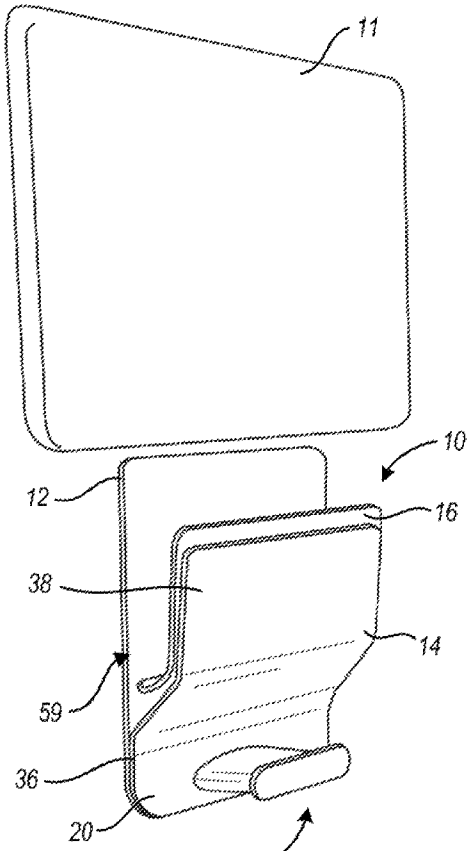
FIG. 4A is a perspective view of the wall mounted storage device with an integrated hinge of FIG. 1, illustrating the wall mounted storage device with an integrated hinge in an open position and an object to be secured.
Figure 4B:
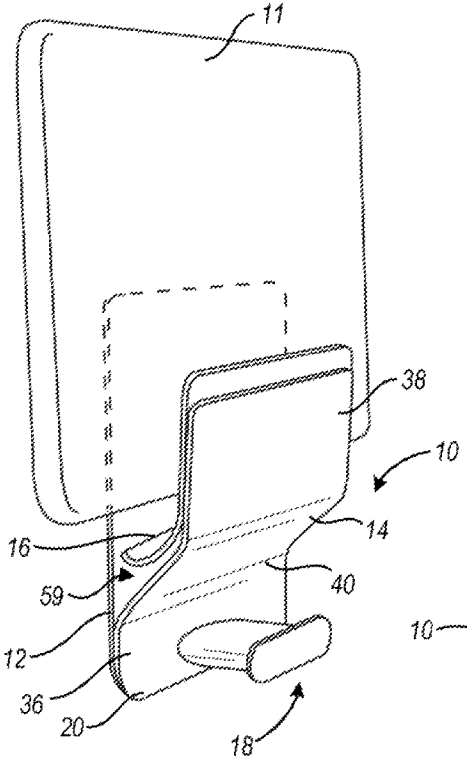
FIG. 4B is a perspective view of the wall mounted storage device with an integrated hinge of FIG. 1, illustrating the wall mounted storage device with an integrated hinge in the open position, with the object in a receiving cavity.
Figure 4C:
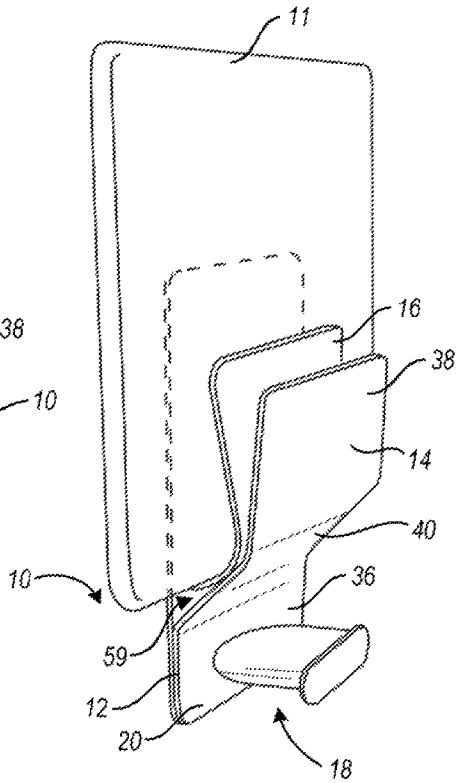
FIG. 4C is a perspective view of the wall mounted storage device with an integrated hinge of FIG. 1, illustrating the wall mounted storage device with an integrated hinge in a closed position.
Figure 5A:
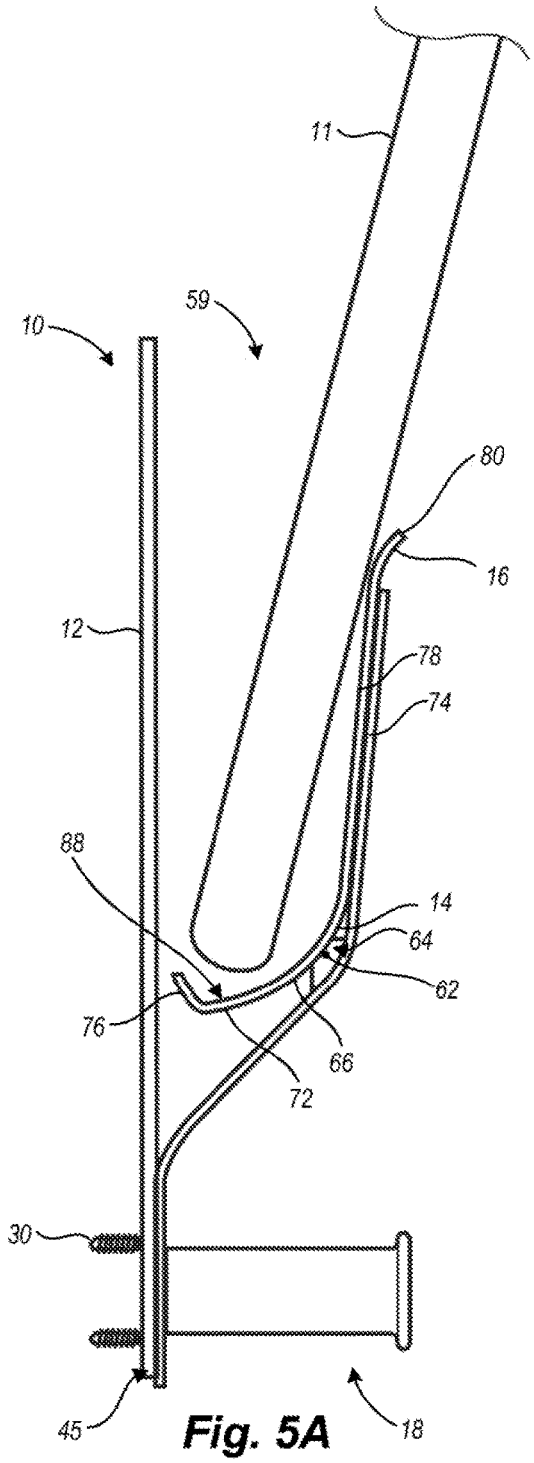
FIG. 5A is a side elevation view of the wall mounted storage device with an integrated hinge of FIG. 1, illustrating the wall mounted storage device with an integrated hinge in the open position, with the object in the receiving cavity.
Figure 5B:
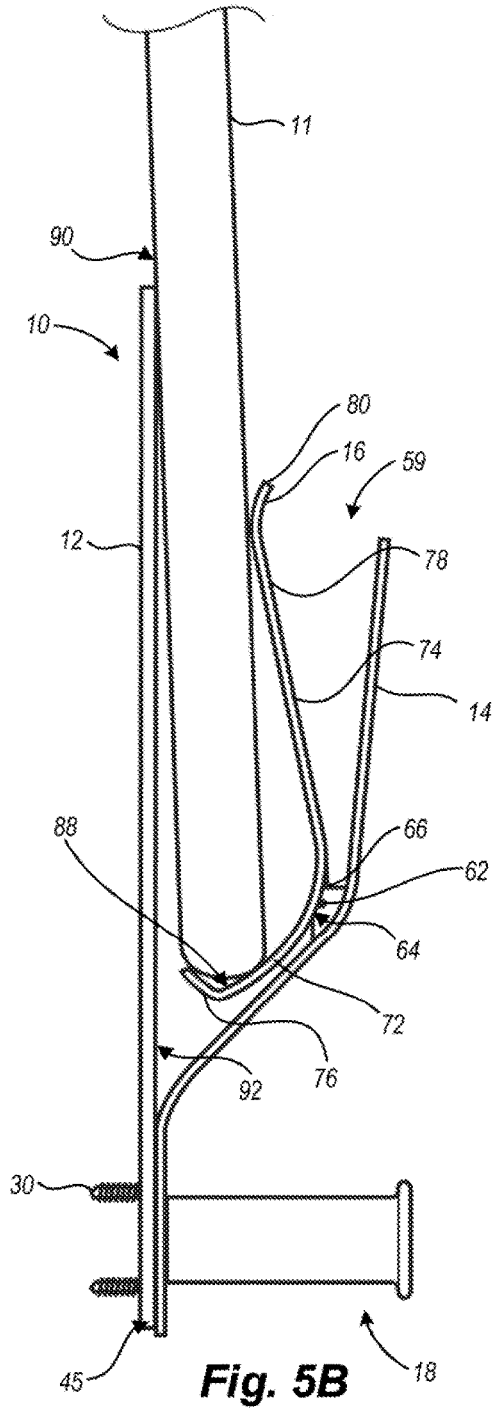
FIG. 5B is a side elevation view of the wall mounted storage device with an integrated hinge of FIG. 1, illustrating the wall mounted storage device with an integrated hinge in the closed position.

Referring now to FIGS. 4A through 4C and FIGS. 5A and 5B, as discussed above, the wall mounted storage device with an integrated hinge 10 can coupleably receive the object 11 in the receiving cavity 59. FIG. 4A illustrates the wall mounted storage device with an integrated hinge 10 in an open position, prior to the object 11 being received in the receiving cavity 59. FIGS. 4B and 5A illustrate the wall mounted storage device with an integrated hinge 10 in the open position, with the object being received in the receiving cavity 59. FIGS. 4C and 5B illustrate the wall mounted storage device with an integrated hinge 10 in the closed position, with the object received in the receiving cavity 59.

As shown in FIGS. 4A through 4C and FIGS. 5A and 5B, when the object 11 is received in the receiving cavity 59, a portion of the object 11 abuts or makes perceptible contact with a contact surface 88 of the receiving portion 72. A downward force, such as a gravitational force of the object 11, causes the hinge plate 16 to pivotably rotate about the pivot axis 68. Pivotable rotation of the hinge plate 16 causes the securing portion 74 of the hinge plate 16 to rotatably move the object 11 such that a securing surface 90 of the object 11 abuts or makes considerable contact with an interior surface 92 of the mounting plate 12 to secure the object 11 in the receiving cavity 59. The wall mounted storage device with an integrated hinge 10 is therefore arranged to secure the object 11 in a simple, efficient, and robust manner.

An exemplary embodiment of a wall mounted storage device with an integrated hinge 10 includes particular features expressed in Table 1.

TABLE 1

Parameters of an Exemplary Wall Mounted Storage Device With an Integrated Hinge

| Ref. | Structure | Features |
|---|---|---|
| 12 | mounting plate | Length is about 4.00 to 12.00 inches<br>Width is about 5.00 to 12.00 inches<br>Thickness is about 0.06 to 0.25 inches<br>Cutout to receive corresponding mounting member<br>Radius of corners is about 0.00 to 3.00 inches<br>Plastic; polyethylene |
| 14 | exterior plate | Length is about 4.00 to 12.00 inches<br>Width is about 1.50 to 8.00 inches<br>Thickness is about 0.06 to 0.25 inches<br>Radius of corners is about 0.00 to 3.00 inches<br>Inside radius of bends is about 0.50 to 3.00 inches<br>304 Stainless Steel; horizontal brushed finish (#3) on exterior face; natural finish on interior face |
| 16 | hinge plate | Length is about 4.00 to 12.00 inches<br>Width is about 4.00 to 10.00 inches<br>Depth is about 1.50 to 4.00 inches<br>Thickness is about 0.06 to 0.25 inches<br>Radius of corners is about 0.00 inches to 3.00 inches<br>Inside radius of bends is about 0.50 to 12.00 inches<br>Plastic; polyethylene |
| 18 | hook member | Length is about 1.50 to 5.00 inches; substantially oblong<br>Width is about 0.50 to 2.00 inches<br>Depth is about 1.00 to 5.00 inches<br>Plastic; polyethylene |
| 26 | mounting member | Length is about 2.50 to 10.00 inches; substantially trapezoidal<br>Width is about 0.75 to 6.00 inches<br>Thickness is about 0.06 to 0.25 inches |
| 66 | pivot pin | Length is about 4.00 to 12.00 inches<br>Diameter is about 0.08 to 0.38 inches<br>Steel, mill finish, cold rolled |

The parameters of Table 1 are non-limiting and exemplary only. The parameters of Table 1 set forth one set of dimensions, materials, finishes, and the like that may be used. In other embodiments, the various components of the wall mounted storage device with an integrated hinge 10 may have different dimensions, materials, and configurations. In addition, some components may optionally be removed, added, or arranged in a different way from that which is expressly illustrated and described in the present disclosure.

A bracket means such as mounting member 26 has one or more holes or other apertures 28 which cooperate with mounting hardware to couple the bracket means to a substantially vertical surface. Apertures 28 may be formed with a through-hole having a diameter of about 0.12 inches to about 0.38 inches, and any aperture 28 may also be countersunk to accept a cooperating fastener (i.e., mounting hardware) such has a screw, a rivet, or some other attachment means.

The bracket means has a generally trapezoidal shape, but other shapes including rectangles, triangles, and the like are also considered. The parallel sides of the bracket means may be about 2.50 inches to about 10.00 inches. The trapezoidal bracket means has a width that is about 0.75 inches to about 6.00 inches. In one case, a longer parallel side of the bracket means is about 4.25 inches, a shorter parallel side is about 3.00 inches, and a width is about 1.36 inches. The bracket means may be formed by metal (e.g., steel, aluminum, brass, copper), plastic (e.g., polyethylene), wood (e.g., oak, cherry), a composite material, or some other one or more materials to a thickness of about 0.06 inches to about 0.25 inches. In one case, the bracket means is formed from cold rolled steel, about 0.12 inches thick, and having a mill finish.

The bracket means may optionally include one or more hook mounting means to receive a hook member. The hook mounting means may be threaded posts, rods, edges, or some other type of protrusion, depression, or the like. In such cases where the hook mounting means is a threaded rod or some other like structure, the hook mounting means may have an outside diameter of about 0.12 inches to about 0.50 inches. In one case, two bracket means each have a diameter of about 0.25 inches, a length of about 0.50 inches to 3.00 inches and a thread pattern of about 20 threads per inch. The two bracket means are welded or otherwise affixed substantially perpendicular to the bracket means.

Prior to securing the bracket means, the bracket means is longitudinally aligned on the substantially vertical surface. Longitudinal alignment includes substantially "leveling" the bracket means or otherwise arranging the bracket means in a visually desirable way. After such alignment, the bracket means is fastened to the substantially vertical surface via at least one fastener. In some cases, two, four, or some other number of fasteners, such as screws, are used to fixedly attach the bracket means to the substantially vertical surface.

A mounting plate means such as mounting plate 12 is generally rectangular, but other shapes are contemplated. The mounting plate means is formed with a length of about 4.00 inches to about 12.00 inches, a width of about 5.00 inches to about 12.00 inches, and a thickness of about 0.06 inches to about 0.25 inches. Corners of the mounting plate means may be square or rounded. Along these lines, said corners may have a radius of about 0.00 inches to about 3.00 inches.

The mounting plate means may be formed of metal (e.g., steel, aluminum, brass, copper), plastic (e.g., polyethylene), wood (e.g., oak, cherry), a composite material, or some other one or more materials. In some cases, the mounting plate means and the bracket means are formed with the same material or with two or more visually complementary materials. In many cases, the mounting plate means and the bracket means have about the same thickness.

The mounting plate means may further be formed with a "cutout" to receive a corresponding bracket means. For example, when the bracket means has a generally trapezoidal shape, the mounting plate means will include a cooperatively sized trapezoidal cutout to receive the bracket means. In one case, the mounting plate means has a length of about 7.50 inches, a width of about 9.00 inches, a thickness of about 0.12 inches, and trapezoidal cutout substantially matching that of the exemplary bracket means. In this case, the mounting plate means is formed from polyethylene plastic having one or more desirable visual characteristics such as color (e.g., black, white, green, red, or another one or more colors), pattern (e.g., geometric shapes, artistic design, commercial logo), texture (e.g., smooth, anti-static, knurled), and the like.

In some embodiments, the mounting plate means includes additional apertures or other features. In some cases, the additional apertures or other features are used to affix the mounting plate means to a substantially vertical surface. In these or alternative cases, the additional apertures or other features are used to affix a hinge means, a hook means, or another means to the mounting plate means. The additional apertures or other features can also be used for other reasons.

After fastening the bracket means to the substantially vertical surface, the mounting plate means is cooperatively arranged about the bracket means. The mounting plate means is optionally fastened to the substantially vertical surface via at least one fastener. Alternatively, the mounting plate means is frictionally, gravitationally, or otherwise removably coupled to the bracket means without being fastened to the substantially vertical surface.

One or more support means are recognized. The one or more support means include mounting tabs, support beams, protrusions, edges, depressions or other like structures. The support means may be separate and distinct from other structures of the wall mounted storage device with an integrated hinge 10, or the support means may be integrated with some other portion of the wall mounted storage device with an integrated hinge 10 such as exterior plate 14. In one case, two or more support means are metal or plastic mounting tabs about 0.25 inches to about 2.00 inches in length, about 1.00 inches to about 3.00 inches in width, and about 0.75 inches to about 3.00 inches in depth. In this case, the two or more support means include protrusions that frictionally or otherwise cooperate with apertures in the mounting plate means.

A cradle means such as hinge plate 16 can be formed from a generally rectangular sheet of material into a shaped frame or holder for an object 11. Other shapes are also contemplated, though a rectangular shape is discussed for simplicity of the disclosure. The cradle means can be formed from polyethylene or another type of plastic, aluminum or another type of metal, wood, a composite material, or some other type of material. The cradle means may be formed or otherwise adapted to have desirable visual characteristics such as one or more colors (e.g., black, white, green, red), pattern (e.g., geometric shapes, artistic design, commercial logo), texture (e.g., smooth, anti-static, knurled), and the like.

The generally rectangular shape of the cradle means prior to its final shape (e.g., hinge plate 16 illustrated in FIG. 1) is about 4.00 inches to about 12.00 inches in length. The width of the cradle means prior to final formation is about 4.00 inches to about 10.00 inches, and the thickness is about 0.06 inches to about 0.25 inches. The rectangular shape of the cradle means may have square or rounded corners having a radius of about 0.00 inches to about 3.00 inches.

After formation, the cradle means includes one or more longitudinal bends, some of which may be in opposing directions. For example, a first longitudinal bend in the lower portion of the cradle is arranged to receive an object 11, and a second longitudinal bend in the upper portion of the cradle is arranged to soften an opening in the cradle means for entry of the object 11. The first and second bends, formed in opposing directions, may be formed having an inside radius of about 0.50 inches to about 12.00 inches. After final formation, the cradle means may have a depth of about 1.50 inches to about 4.00 inches. It is further recognized that the cradle means may be initially created in its final shape and not created first in a rectangular or other shape that is later bent or otherwise arranged into the final shape.

In one case, the cradle means is about 7.50 inches long, about 6.00 inches wide, and about 0.06 inches thick, and the cradle means is formed from a polyethylene plastic. After final formation, the cradle means is about 2.00 inches deep. A first bend at the top of the cradle means has an inside radius of about 2.00 inches; a second bend, opposing the first bend, in the lower portion of the cradle means has an inside radius of about 10.00 inches; and a third bend, opposing the first bend and cooperating with the second bend, at the bottom of the cradle means is formed at about an acute angle or having an inside radius of about 0.50 inches.

Integrated with the cradle means is a hinge member means such as hinge member 62. The hinge member means may be concurrently formed with the cradle means or formed separate from the cradle means and later affixed to the cradle means. The hinge member means may include one or more shaped structures having one or more apertures to receive a rotation means such as pivot pin 66.

A rotation means such as pivot pin 66 may be formed from a rod, a partially or fully threaded rod, or some other like structure. The rotation means may be about 4.00 inches to about 12.00 inches long, and the rotating mean may have a diameter of about 0.08 inches to about 0.38 inches. In some cases, the rotation means is formed from mill finished, cold rolled steel, though extruded plastic or other materials may also be used. In some cases, the rotation means is formed having multiple shapes such that contact points have fully or partially rounded portions, and non-contact points have square or otherwise non-rounded portions.

In some cases, the wall mounted storage device with an integrated hinge 10 also includes a biasing means such as a spring, piece of spring steel, a piece of shaped plastic under stress, or some other structure. The biasing means is disposed on the rotation means, in proximity to the rotation means, or in another location. The biasing means may be arranged to influence the cradle means into an open position when no object 11 is present. In the alternative, or in addition, the biasing means may be arranged to influence the cradle means into a closed position when an object 11 is present. The biasing means may in some cases apply between about 4 ounces and about 4 pounds of influence to the cradle.

The rotation means is arranged to cooperatively join the cradle means to a support means which may be separately formed or which may be integrated with an exterior plate means. For example, one or more apertures in one or more hinge member means are aligned or otherwise cooperatively mated with corresponding apertures in corresponding support structure means. The rotation means is threaded or otherwise introduced through the apertures such that when so arranged, the cradle means is permitted to rotate about the rotation means, which is an axis for the cradle means.

An exterior plate means such as exterior plate 14 is coupled to the mounting plate means. The exterior plate means is shaped so as to form a cavity in which to cooperatively receive the cradle means. Prior to forming the exterior plate means into a final shape, the exterior plate means may be a generally rectangular sheet having a length of about 4.00 inches to about 12.00 inches, a width of about 1.50 inches to about 8.00 inches, and a thickness of about 0.06 inches to about 0.25 inches. The exterior plate means may have square corners, truncated corners, or rounded corners with a radius of about 0.00 inches to about 3.00 inches. The exterior plate may be formed from metal (e.g., steel, aluminum, brass, copper), plastic (e.g., polyethylene), wood (e.g., oak, cherry), a composite material, or some other one or more materials.

The exterior plate means includes two or more opposing longitudinal bends. For example, in some cases, the longitudinal bends visually segment the exterior plate into an upper portion, an intermediate portion, and a lower portion. In these cases, the upper portion of the exterior plate means partially forms the cavity that receives the cradle means, the intermediate portion includes or otherwise cooperates with the support structure means, and the lower portion in whole or in part is coupled to the bracket means. The two or more opposing longitudinal bends are formed having an inside radius of about 0.50 inches to about 6.00 inches. In addition, or in the alternative, a first longitudinal bend may form an acute angle to a substantially vertical plane, and a second longitudinal bend may form an obtuse angle to the substantially vertical plane. The angles of the first and second longitudinal bends may also be arranged vice versa.

In one case, the exterior plate means is formed from a generally rectangular piece of 304 Stainless Steel, having a horizontal brushed finish (#3) on its exterior face and a natural finish on its interior face. In this case, the exterior plate means is about 0.06 inches thick, about 7.5 inches long, and about 7.5 inches wide. A first longitudinal bend has an inside radius of about 0.75 inches and the second opposing longitudinal bend has an inside radius of about 0.75 inches. In one case, the support means earlier described are integrated into the structure of the exterior plate means. In this case, the external plate means is coupled to the bracket means. For example, the lower portion of the external place means may be formed with one or more apertures (e.g., external plate apertures 42) that receive the one or more hook mounting means of the bracket means. When the hook mounting means are a threaded rod having a diameter of about 0.25 inches, the apertures may be arranged to traverse the threaded rod such that interior surface of the exterior plate means comes in direct contact or indirect contact (e.g., via one or more intermediary materials) with the exterior surface of the bracket means.

A suitable structure may be used to removably affix the external plate means to the bracket means. For example, where the hook mounting means is formed from threaded post or rod material, the suitable structure may be a cooperatively threaded barrel structure, which is screwed onto the hook mounting means. The threaded barrel structure may be cylindrical or have some other shape. When suitably tightened, the one or more threaded barrel structures securely couple the external plate means in a substantially vertical orientation to either or both of the bracket means and the mounting plate means.

A hook means such as hook member 18 may be formed from wood, metal, plastic, rubber, a composite material, or any other suitable material. The hook means may be formed with functional characteristics, aesthetically appealing characteristics, or a combination of functional and aesthetically appealing characteristics. The hook means may be frictionally or otherwise introduced directly to the hook mounting means, or the hook means may be introduced to some intermediate structure. In some cases, for example, the barrel structures described herein may comprise the hook means. The hook means may include colors, textures, shapes, advertising or other commercial messaging, corporate messaging, instructions, text, icons, or nearly any other functional or aesthetically appealing characteristics. In one case the hook means has an oblong cross section, a plate portion to serve as a lip or other device to keep objects secured thereto, and a stem portion that covers the hook mounting means.

In some cases, the hook means is about 1.50 inches to about 5.00 inches long, about 0.50 inches to about 2.00 inches wide, and about 1.00 inches to about 5.00 inches deep. In one case, the hook means is a colored polyethylene structure having an oblong cross-section with at least two parallel sides. In this case, the hook means is about 3.00 inches long, about 1.00 inches wide and about 2.25 inches deep.

Once so constructed, the wall mounted storage device with an integrated hinge 10 is arranged to receive an object 11, which may be a tablet computer, a laptop computer, a mobile device such as cell phone, a book, a stack of papers, one or more periodicals, a briefcase, or any other object suitably sized and shaped to enter the cavity formed between the mounting plate means and the cradle means.

When a user imposes the object 11 into the cavity, the object 11 will bear down, load, oppress, burden, or otherwise contact a receiving recess in the lower portion of the cradle means. The mass of the object 11 alone or with additional force supplied by a user will cause the cradle means to rotate on an axis formed by the rotation means (e.g., pivot pin 66) from an open position to a closed position. When a biasing means is arranged in the wall mounted storage device with an integrated hinge 10, the imposed bias is overcome. After the object 11 has fully entered the cavity, downward motion and rotation stops, and the object 11 is suitably compressed between the upper portion of the cradle means and the upper portion of the mounting plate means.

Subsequently, when the user removes the object 11 from the cavity via upward force on the object 11, the cradle means is caused to reversibly rotate on the axis formed by the rotation means. The cradle means returns the closed position to the open position. In some cases, the biasing mechanism or the other suitable formation of components as described herein provides the perception of an upward force ejecting the object 11 from the cavity. For example, as the user removes the object 11 from its substantially vertical position resting in the wall mounted storage device with an integrated hinge 10, the user will often apply both an upward force and an outward force to their object 11. The outward force on the upper portion of the cradle means translates through the cradle means to an upward force through the lower lip portion of the cradle means. Accordingly, in some cases, the user's own supplied outward force is perceived as an externally supplied upward force to their object 11.

Moreover, aspects of the embodiments can be modified, if necessary to employ concepts of the various patents, applications and publications to provide yet further embodiments.

These and other changes can be made to the embodiments in light of the description detailed here. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A storage device with an integrated hinge coupleable to a structure, comprising:

a mounting plate;

an external plate coupled to the mounting plate to define a receiving cavity, said external plate having a lower portion, an upper portion, and an intermediate portion, said intermediate portion extending outwardly at a non-zero angle with respect to an outer surface of the lower portion; and a hinge plate received in the receiving cavity and coupled to the external plate, the hinge plate pivotably moveable about a pivot axis between an open position and a closed position, the hinge plate including a receiving portion at a lower end of the hinge plate and a securing portion at an upper end of the hinge plate, the receiving portion of the hinge plate being configured to receive and support an object when the object is positioned within the receiving cavity, and the securing portion being configured to move toward the mounting plate to secure the object between the securing portion and the mounting plate as the hinge plate moves from the open position to the closed position in response to the object engaging the receiving portion of the hinge plate.

2. A storage device with an integrated hinge according to claim 1, further comprising:

a hook member extending substantially perpendicular relative to the mounting plate.

3. A storage device with an integrated hinge according to claim 2, further comprising:

a mounting member coupleable to the structure, the mounting member including a threaded component, the threaded component configured to couple the mounting member to the hook member.

4. A storage device with an integrated hinge according to claim 3 wherein the hook member includes an insert, the insert configured to coupleably receive the threaded component.

5. A storage device with an integrated hinge according to claim 1 wherein the hinge plate is arranged to translate an outward force imposed on the object into a perceptible upward force imposed on the object.

6. A storage device with an integrated hinge according to claim 1, further comprising:

a mounting member coupleable to the structure, wherein the mounting plate includes a cutout portion shaped to cooperate with a perimeter shape of the mounting member.

7. A storage device with an integrated hinge according to claim 1 wherein at least one external surface of the storage device is arranged with a commercial message or an instructive message.

8. A storage device with an integrated hinge according to claim 1, wherein the external plate further comprises:

a pivot pin; and a support structure mechanism, wherein the support structure mechanism is coupled to the hinge plate via the pivot pin.

9. A storage device with an integrated hinge according to claim 8 wherein the support structure mechanism is integrated with the external plate.

10. A storage device method, comprising:

longitudinally aligning a mounting plate system on a substantially vertical surface, the mounting plate system having at least one hook structure protruding substantially perpendicular to a planar surface of the mounting plate system;

fastening the mounting plate system to the substantially vertical surface via at least one fastener;

aligning one or more apertures in a hinge plate with one or more corresponding apertures in a support structure;

introducing a pivot pin through the one or more apertures in the hinge plate with the one or more corresponding apertures in the support structure, the pivot pin arranged to render the hinge plate pivotably moveable between an open position and a closed position, the hinge plate including a receiving portion at a lower end of the hinge plate and a securing portion at an upper end of the hinge plate, the receiving portion of the hinge plate being configured to receive and support an object when the object is positioned within the storage device, and the securing portion being configured to move toward the mounting plate to secure the object between the securing portion and the mounting plate system as the hinge plate moves from the open position to the closed position in response to the object engaging the receiving portion of the hinge plate; and coupling an external plate to the mounting plate system, the external plate having an upper portion, an intermediate portion, and a lower portion, the upper portion in part forming a cavity to receive the hinge plate, the intermediate portion in proximity to the support structure and extending outwardly at a non-zero angle with respect to an outer surface of the lower portion, and the lower portion contacting the mounting member.

11. A storage device method according to claim 10 wherein the support structure is integrated with the external plate.

12. A storage device method according to claim 10, comprising:

introducing an object into a cavity between the mounting plate system and the hinge plate;

advancing the object downward within the cavity, the advancing causing the hinge plate to pivot toward the closed position.

13. A storage device method according to claim 12, comprising:

withdrawing the object upward and outward from the cavity between the mounting plate system and the hinge plate, the outward withdrawing imposing a force on a first portion of the hinge plate, the force translated through the hinge plate into an upward force on the object.

14. A storage device method according to claim 10, comprising:

fastening the mounting plate system to the substantially vertical surface.

* * * * *